US005281891A

United States Patent [19]

Kaneko et al.

[11] Patent Number: 5,281,891

[45] Date of Patent: Jan. 25, 1994

[54] ELECTRON EMISSION ELEMENT

[75] Inventors: Akira Kaneko, Tokyo; Toru Kanno; Keiko Morishita, both of Kawasaki, all of Japan

[73] Assignee: Matsushita Electric Industrial Co., Ltd., Osaka, Japan

[21] Appl. No.: 836,894

[22] Filed: Feb. 19, 1992

[30] Foreign Application Priority Data

Feb. 22, 1991 [JP] Japan ..... 3-028529

[51] Int. Cl.[5] ..... H01J 1/02

[52] U.S. Cl. ..... 313/309; 313/336; 313/351

[58] Field of Search ..... 313/309, 310, 336, 351

[56] References Cited

U.S. PATENT DOCUMENTS

| | | | |
|---|---|---|---|
| 4,728,851 | 3/1988 | Lambe | 313/309 |
| 4,827,177 | 5/1989 | Lee et al. | 313/309 |
| 4,943,343 | 7/1990 | Bardai et al. . | |

FOREIGN PATENT DOCUMENTS

| | | | |
|---|---|---|---|
| 0260075 | 3/1988 | European Pat. Off. . | |
| 0434001 | 6/1991 | European Pat. Off. . | |
| 0033833 | 2/1989 | Japan | 313/336 |
| 0467526 | 3/1992 | Japan | 313/309 |

OTHER PUBLICATIONS

"Observation and Control of Liquid Crystal Molecules by STM" Densoken News No. 493, Feb., 1991.

"A Thin-Film Field-Emission Cathode" by C. A. Spindt; Journal of Applied Physics, vol. 39, No. 7 pp. 3504-3505, Dec. 1968.

"Field Emission Triodes" by Robert E. Neidert et al.; IEEE Transactions on Electron Devices, vol. 38, No. 3, Mar. 1991, pp. 661-665.

"Vacuum Microtriode Characteristics" by W. N. Carr et al.; J. Vac. Sci. Tchnol., A8(4), Jul./Aug. 1990 pp. 3581-3585.

"Fabrication and Operation of Silicon Micro-Field--Emitter-Array" by K. Betsui, Autumn Meeting of Japanese Society of Electronics, (1990) Densoken News; Feb. 19, 1992.

*Primary Examiner*—Donald J. Yusko
*Assistant Examiner*—N. D. Patel
*Attorney, Agent, or Firm*—Lowe, Price, LeBlanc & Becker

[57] ABSTRACT

An electron emission element includes an insulating substrate. A base electrode is formed on the insulating substrate. A plurality of emitters are formed on the base electrode and are arranged radially with respect to a given point. The emitters have wedge shapes with their respective tips facing inward. An insulating layer is formed on the substrate and the base electrode, and is spaced from the wedges of the emitters by given gaps. A control electrode is formed on the insulating layer for enabling electrons to be emitted from the tips of the wedge-shaped emitters.

15 Claims, 6 Drawing Sheets

ELECTRON EMISSION ELEMENT

FIELD OF THE INVENTION

This invention relates to an electron emission element usable in various apparatus such as an electron microscope, an electron beam exposure apparatus, a cathode-ray tube (CRT), or other electron beam apparatus.

Recently, electron emission elements dispensing with a heating process have been widely studied. Typical examples of such electron emission elements are field emitters and micro-field-emitters.

A general field emitter includes an emitter tip which is made into a needle shape so as to have a curvature radius of several hundreds of nanometers or smaller. An electric field having a strength of about $10^7$ V/cm is concentrated on the emitter tip, forcing electrons to be emitted from the emitter tip. Such a field emitter certain advantages, that is, (1) a high current density and (2) a low power consumption.

As will be explained later, prior art electron emission elements have some problems.

SUMMARY OF THE INVENTION

It is a principal object of this invention to provide an improved electron emission element.

A first aspect of this invention provides an electron emission element comprising an insulating substrate; a base electrode formed on the insulating substrate; a plurality of emitters formed on the base electrode and arranged radially with respect to a given point, the emitters having respective wedges facing inward; an insulating layer formed on the substrate and the base electrode and spaced from the wedges of the emitters by given gaps; and a control electrode formed on the insulating layer for enabling electrons to be emitted from the wedges of the emitters.

A second aspect of this invention provides an electron emission element comprising an insulating substrate; a base electrode formed on the insulating substrate; a plurality of emitters formed on the base electrode and arranged radially with respect to a given point, the emitters having respective wedges facing inward; a first insulating layer formed on the substrate and the base electrode and spaced from the wedges of the emitters by given gaps; a first control electrode formed on the first insulating layer for enabling electrons to be emitted from the wedges of the emitters; a second insulating layer formed on a region of the first control electrode and extending radially outward of the emitters; and a second control electrode formed on the second insulating layer.

DESCRIPTION OF THE PRIOR ART

Journal of Applied Physics, Vol. 39, No. 7, p 3504, 1968, discloses a prior art field emitter. This prior art field emitter will be described hereinafter with reference to FIGS. 1 and 2.

Figure 1:
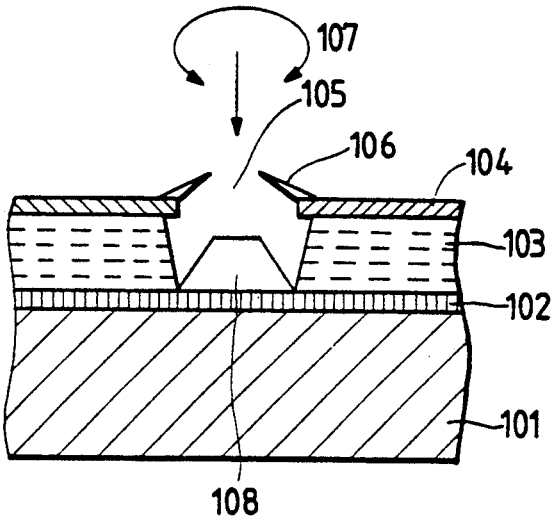
FIG. 1 PRIOR ART
FIG. 1 is a sectional view of a prior art field emitter in a state during the fabrication thereof.
Figure 2:
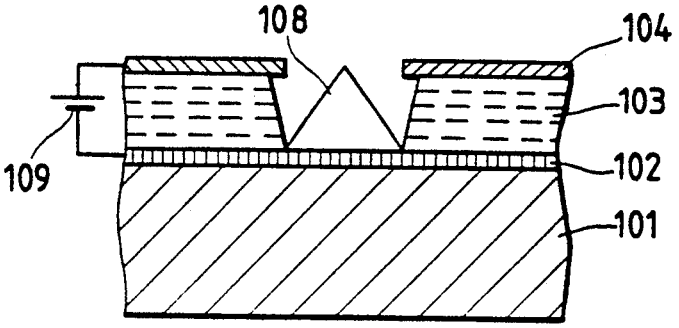
FIG. 2 PRIOR ART
FIG. 2 is a sectional view of the prior art field emitter of FIG. 1 which is in a finished state.

As shown in FIGS. 1 and 2, the prior art field emitter includes an electrically insulating substrate (base plate) 101. During the fabrication of the prior art field emitter, as shown in FIG. 1, an electrically conductive film 102, an electrically insulating layer 103, and an electrically conductive film 104 are sequentially formed on the substrate 101 by vapor deposition processes using suitable masks. As a result of the function of the masks, an array of cavities 105 are formed in the insulating layer 103 and the conductive film 104.

While an inlet of each cavity 105 is gradually closed by a mask member 106 which is grown in a rotation tilt vapor deposition process, emitter material 107 is vapor-deposited, from directly above the center of the cavity 105, on the part of the conductive film 102 defining the bottom of the cavity 105. The deposited emitter material 107 finally forms a tapered emitter projection 108. The mask member 106 is made of suitable material. At an end stage of the fabrication, the mask member 106 is removed so that a field emitter is completed as shown in FIG. 2.

The prior art field emitter of FIGS. 1 and 2 operates as follows. The negative terminal and the positive terminal of a power supply 109 are connected to the conductive films 102 and 104 respectively so that the voltage of the power supply 109 is applied between the conductive films 102 and 104. The applied voltage generates an electric field which is concentrated on the tip of the emitter projection 108. By setting the applied voltage to a level equal to or higher than a threshold determined by the characteristics of the emitter material 107, electrons are emitted from the tip of the emitter projection 108 on which the electric field is concentrated.

The prior art field emitter of FIGS. 1 and 2 has the following problem. As described previously, during the stage of the fabrication which makes the emitter projection 108, it is necessary to simultaneously execute the rotation tilt vapor deposition and the normal deposition to form the emitter projection 108 and the mask member 106. In general, it is difficult to accurately control the simultaneously-executed two deposition processes.

DESCRIPTION OF THE BACKGROUND ART

Before the description of embodiments of this invention, a background-art device will be explained hereinafter for a better understanding of this invention.

Figure 3:
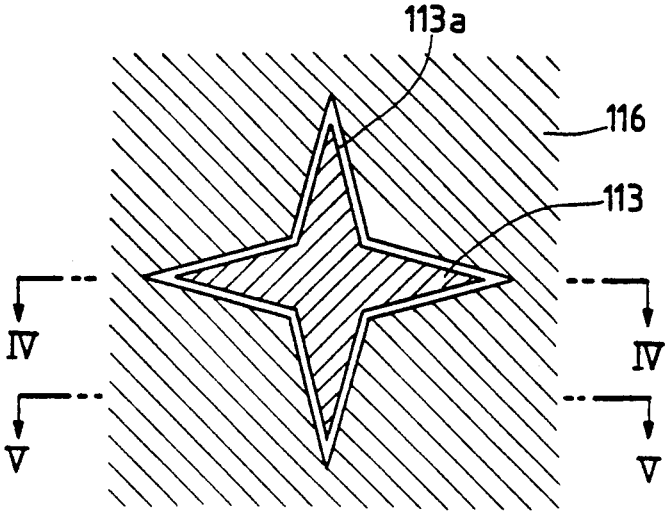
FIG. 3 PRIOR ART
FIG. 3 is a sectional view of a background-art electron emission element according to a first embodiment of this invention.
Figure 4:
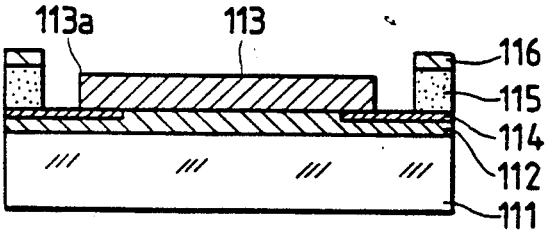
FIG. 4 PRIOR ART
FIG. 4 is a sectional view of the background-art electron emission element, taken along the line IV—IV of FIG. 3.
Figure 5:
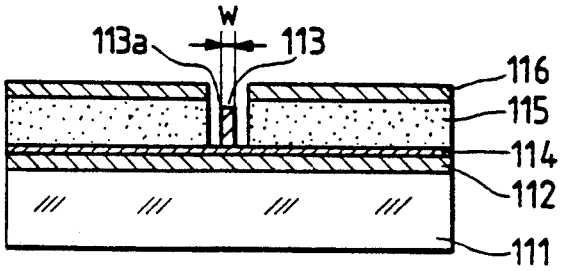
FIG. 5 PRIOR ART
FIG. 5 is a sectional view of the background-art-electron emission element, taken along the line V—V of FIG. 3.

With reference to FIGS. 3-5, a prior art electron emission element includes a substrate 111 made of insulating material such as glass. A layer of a base electrode 112 is formed on the substrate 111. An emitter layer 113 is formed on the base electrode 112. A current can flow from the base electrode 112 to the emitter layer 113. The emitter layer 113 is made of suitable material such as Si, ZrC, TiC, Mo, or W which has a low work function and a high melting point.

The emitter layer 113 has a crisscross shape, having four projections with edges or tips 113*a* which are spaced by equal angular intervals. Each of the projections has a rectangular or trapezoidal cross-section. Each of the projections is tapered at a fixed rate, having a horizontal width W which linearly decreases from a given value to zero in the direction from the center of the crisscross shape to the related edge 113*a*.

An insulating layer 114 is formed on the portion of the base electrode 112 which extends below outer edges of the emitter layer 113 and which extends outward of the emitter layer 113.

An insulating layer 115 is formed on the insulating layer 114. The insulating layer 115 is horizontally spaced from the emitter layer 113 by a given gap. Specifically, the insulating layer 115 is provided with a recess having a crisscross shape similar to and slightly greater than the crisscross shape of the emitter layer 113, and the emitter layer 113 is located in the recess of the insulating layer 115. The recess of the insulating layer 115 has tapered portions conforming to the tapered projections of the emitter layer 113. The insulating layer 115 is made of, for example, $Al_2O_3$ or $SiO_2$. The insulating layer 115 has a thickness equal to or greater than the thickness of the emitter layer 113. A layer of a control electrode 116 is superposed on the insulating layer 115. The control electrode 116 has a crisscross opening with tapered portions conforming to the tapered projections of the emitter layer 113. The control electrode 116 is made of, for example, metal. The control electrode 116 functions to help the emission of electrons from the emitter layer 113.

The electron emission element of FIGS. 3-5 operates as follows. When a voltage is applied between the emitter layer 113 and the control electrode 116 in a manner such that the emitter layer 113 is subjected to a negative potential relative to the control electrode 116, lines of an electric force are concentrated on the edge 113*a* of each projection of the emitter layer 113 so that a strong electric field is applied to the edge 113*a*. The strong electric field applied to the edge 113*a* forces electrons to be emitted from the edge 113*a*.

The tapered design of the emitter layer 113 and the corresponding tapered design of the control electrode 116 ensure that a variation in the accuracy of the patterns of the emitter layer 113 and the control electrode 116 can be compensated and thus stable electron emission characteristics can be always maintained.

DESCRIPTION OF THE FIRST PREFERRED EMBODIMENT

Figure 6:
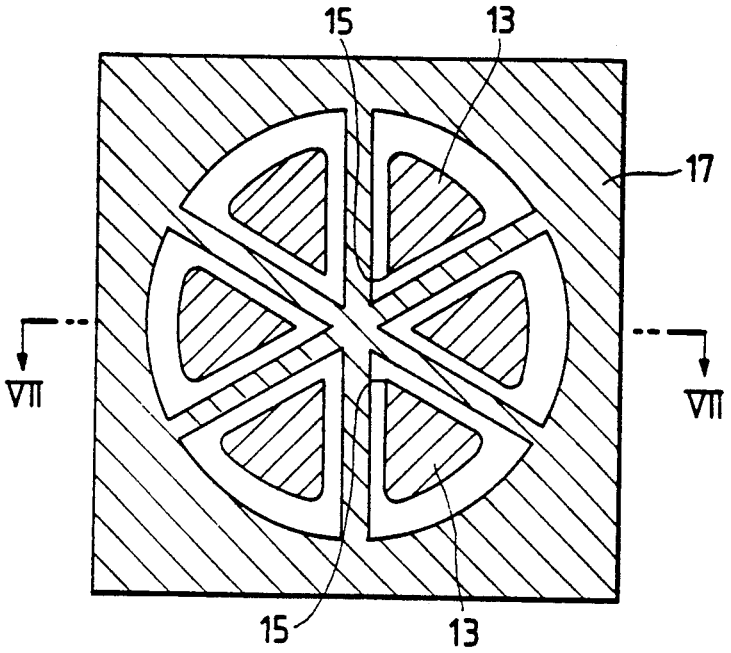
FIG. 6 is a sectional view of an electron emission element according to a first embodiment of this invention.
Figure 7:
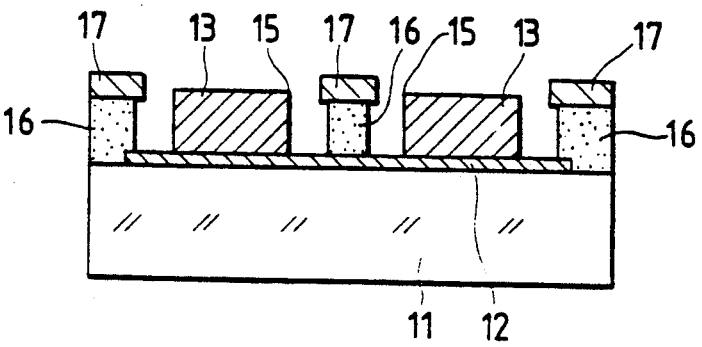
FIG. 7 is a sectional view of the electron emission element, taken along the line VII—VII of FIG. 6.
Figure 8A:
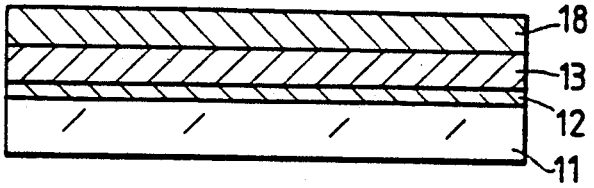
FIGS. 8(*a*)–8(*e*) are sectional views of a substrate and various layers thereon which are in various phases of the fabrication of the electron emission element of FIGS. 6 and 7.
Figure 8B:
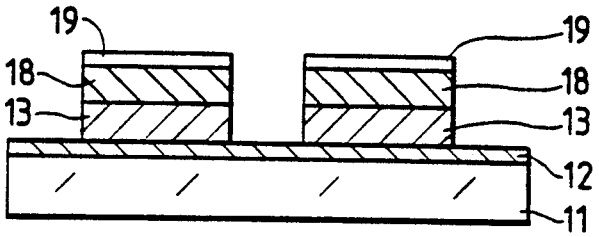
Figure 8C:
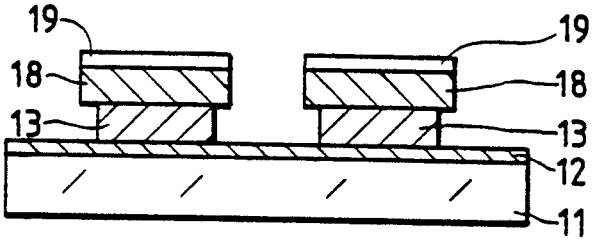
Figure 8D:
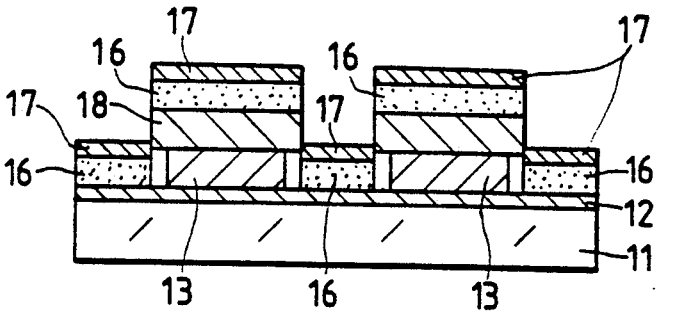
Figure 8E:
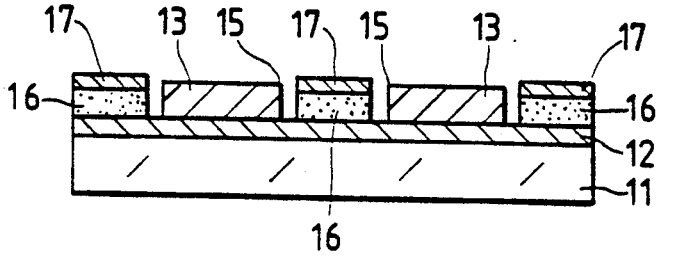

With reference to FIGS. 6 and 7, an electron emission element includes a substrate 11 made of insulating material such as glass or ceramics. A layer of a base electrode 12 is formed on the substrate 11. The base electrode 12 is made of suitable material such as Al, Au, Mo, Cr, or Ta. Emitters 13 having a common shape of a wedge or sector are formed on a given region of the base electrode 12. The emitters 13 are made of suitable material such as Mo, W, ZrC, or $LaB_6$. The emitters 13 are angularly spaced, and the tips 15 of the wedges of the emitters 13 face a common central point. In other words, the emitters 13 are arranged radially with respect to the central point. Each of the emitters 13 has a horizontal width which decreases from a given value to zero in the radial direction toward the central point. In other words, each of the emitters 13 has a tapered design.

An insulating layer 16 made of suitable material such as $SiO_2$, $Al_2O_3$, or $Si_3N_4$ is formed on the substrate 11 and the base electrode 12. The insulating layer 16 surrounds the emitters 13, and is horizontally spaced from the emitters 13 by a given gap. Specifically, the insulating layer 16 has recesses of a shape which is similar to and greater than the shape of the emitters 13, and the recesses accommodate the emitters 13 respectively. A layer forming a control electrode or a collector 17 is superposed on the insulating layer 16. Thus, the control electrode 17 has openings having a shape which is similar to and greater than the shape of the emitters 13, and the emitters 13 are located within the respective openings. The openings of the control electrode 17 have a tapered design corresponding to the tapered design of the emitters 13. The control electrode 17 is made of metal such as Cr, Mo, or W. The control electrode 17 functions to help the emission of electrons from the emitters 13.

The electron emission element of FIGS. 6 and 7 operates as follows. When a voltage is applied between the emitters 13 and the control electrode 17 in a manner such that the emitters 13 are subjected to a negative potential relative to the control electrode 17, lines of an electric force are concentrated on the tip 15 of each of the emitters 13 so that a strong electric field is applied to the tip 15. The strong electric field applied to the tip 15 of each emitter 13 forces electrons to be emitted from the tip 15. The emitted electrons are attracted by the control electrode 17.

Computer simulation shows that the directions of the lines of the electric force have components equal to the directions of the tips 15 of the wedges of the emitters 13. Since the directions of the tips 15 of the emitters 13 face the previously-mentioned common central point, the electrons emitted from the tips 15 move toward the central point as viewed in a horizontal plane. Thus, a resultant beam of the electrons emitted from the respective tips 15 is prevented from expanding outwardly, and maintains a good quality.

The tapered design of the emitters 13 and the corresponding tapered design of the control electrode 17 ensure that a variation in the accuracy of the patterns of the emitters 13 and the control electrode 17 can be compensated and thus stable electron emission characteristics can be always maintained.

The electron emission element of FIGS. 6 and 7 was fabricated as follows. First, as shown in FIG. 8(*a*), an insulating substrate 11 made of suitable material such as glass was prepared, and a film of a base electrode 12 which had a given thickness was formed on the insulating substrate 11 by a suitable method such as a vacuum vapor deposition method or a sputtering method. The base electrode 12 was made of electrically conductive material such as Al, Ta, or Cr. Subsequently, an emitter film 13 having a given thickness was formed on the base electrode film 12 by a method similar to the method of the formation of the base electrode film 12. The emitter film 13 was made of suitable material such as Mo, W, ZrC, or TiC. In addition, a layer of lift-off material 18 was formed on the emitter film 13 by a method similar to the methods of the formation of the base electrode film 12 and the emitter film 13. In this way, the emitter film 13 was coated with the lift-off material layer 18. The lift-off material layer 18 had a given thickness greater than the thickness of an insulating layer 16 described later. The lift-off material layer 18 was composed of metal or insulating material, being able to withstand a later etching process and being prevented from corroding the other materials or films during later fabrication steps.

Subsequently, as shown in FIG. 8(*b*), a photoresist 19 having a pattern corresponding to a desired pattern of semifinished emitters 13 was formed on the lift-off material member 18. The lift-off material member 18 and the emitter film 13 were subjected to an etching process while the photoresist 19 was used as a protective film. As a result, semifinished emitters 13 having a desired configuration and a desired shape were obtained. In addition, the lift-off material member 18 was processed into separated segments corresponding to the semifinished emitters 13. Next, as shown in FIG. 8(*c*), the semifinished emitters 13 were etched into shapes slightly smaller than the shapes of the corresponding lift-off material segments 18.

Subsequently, as shown in FIG. 8(*d*), the photoresist 19 was removed, and then layers of insulating material 16 and layers of a control electrode 17 were sequentially formed on the entire region of the upper surfaces of the substrate by a sputtering method. In order to enhance the characteristics of close contact between the base electrode 12 and the insulating layer 16 and close contact between the insulating layer 16 and the control electrode layer 17, it was preferable to heat the whole of the substrate. Before the heating process, the photoresist 19 was removed as described previously to prevent the occurrence of the fact that the photoresist 19 would be decomposed and thereby could contaminated the other materials or films during the heating process.

Finally, as shown in FIG. 8(*e*), the lift-off material segments 18, and the insulating layers 16 and the control electrode layers 17 extending on the lift-off material segments 18 were removed so that the emitters 13 were exposed.

DESCRIPTION OF THE SECOND PREFERRED EMBODIMENT

Figure 9:
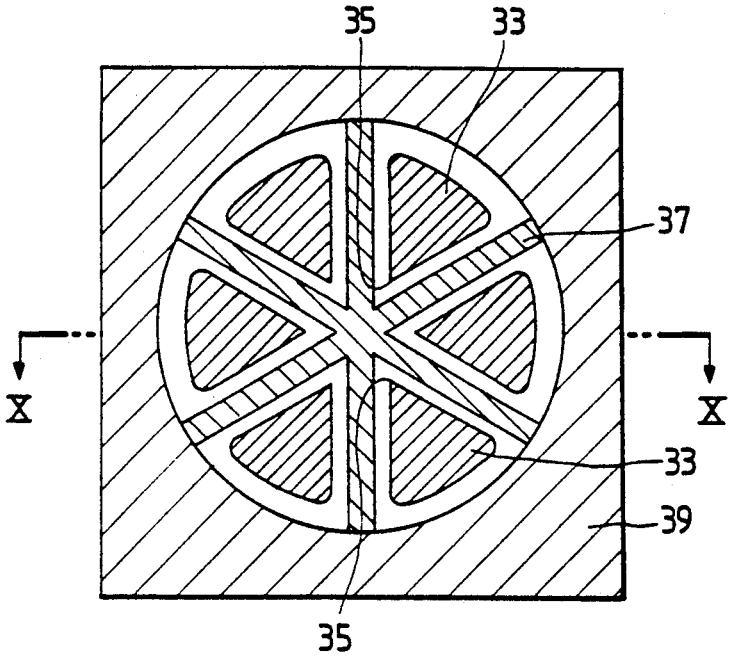
FIG. 9 is a sectional view of an electron emission element according to a second embodiment of this invention.
Figure 10:
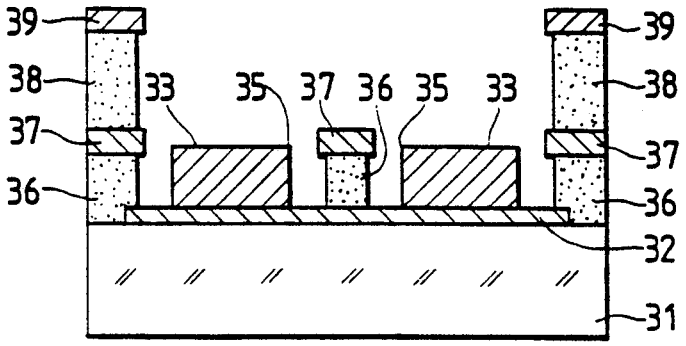
FIG. 10 is a sectional view of the electron emission element, taken along the lines X—X of FIG. 9.

With reference to FIGS. 9 and 10, an electron emission element includes a substrate 31 made of insulating material such as glass or ceramics. A layer of a base electrode 32 is formed on the substrate 31. The base electrode 32 is made of suitable material such as Al, Au, Mo, Cr, or Ta. Emitters 33 having a common shape of a wedge or sector are formed on a given region of the base electrode 32. The emitters 33 are made of suitable material such as Mo, W, ZrC, or $LaB_6$. The emitters 33 are angularly spaced, and the tips 35 of the wedges of the emitters 33 face a common central point. In other words, the emitters 33 are arranged radially with respect to the central point. Each of the emitters 33 has a horizontal width which decreases from a given value to zero in the radial direction toward the central point. In other words, each of the emitters 33 has a tapered design.

An insulating layer 36 made of suitable material such as $SiO_2$, $Al_2O_3$, or $Si_3N_4$ is formed on the substrate 31 and the base electrode 32. The insulating layer 36 surrounds the emitters 33, and is horizontally spaced from the emitters 33 by a given gap. Specifically, the insulating layer 36 has recesses of a shape which is similar to and greater than the shape of the emitters 33, and the recesses accommodate the emitters 33 respectively. A layer of a control electrode 37 is superposed on the insulating layer 36. Thus, the control electrode 37 has openings having a shape which is similar to and greater than the shape of the emitters 33, and the emitters 33 extend in the openings respectively. The openings of the control electrode 37 have a tapered design corresponding to the tapered design of the emitters 33. The control electrode 37 is made of metal such as Cr, Mo, or W. The control electrode 37 functions to help the emission of electrons from the emitters 33.

An insulating layer 38 is formed on the portion of the control electrode 37 which extends outward of the emitters 33. A control electrode 39 is formed on the insulating layer 38. The control electrode 39 is in a position axially and upwardly spaced from the position of the control electrode 37. The control electrode 39 extends radially outward of the emitters 33.

The electron emission element of FIGS. 9 and 10 operates as follows. When a voltage is applied between the emitters 33 and the control electrode 37 in a manner such that the emitters 33 are subjected to a negative potential relative to the control electrode 37, lines of an electric force are concentrated on the tip 35 of each of the emitters 33 so that a strong electric field is applied to the tip 35. The strong electric field applied to the tip 35 of each emitter 33 forces electrons to be emitted from the tip 35. The emitted electrons are attracted by the control electrode 37.

Computer simulation shows that the directions of the lines of the electric force have components equal to the directions of the tips 35 of the wedges of the emitters 33. Since the directions of the tips 35 of the emitters 33 face the previously-mentioned common central point, the electrons emitted from the tips 35 move toward the central point as viewed in a horizontal plane. Thus, a resultant beam of the electrons emitted from the respective tips 35 is prevented from expanding outwardly, and maintains a good quality.

The control electrode 39 is electrically biased so that the electron beam can be further condensed.

The tapered design of the emitters 33 and the corresponding tapered design of the control electrode 37 ensure that a variation in the accuracy of the patterns of the emitters 33 and the control electrode 37 can be compensated and thus stable electron emission characteristics can be always maintained.

DESCRIPTION OF THE THIRD PREFERRED EMBODIMENT

Figure 11:
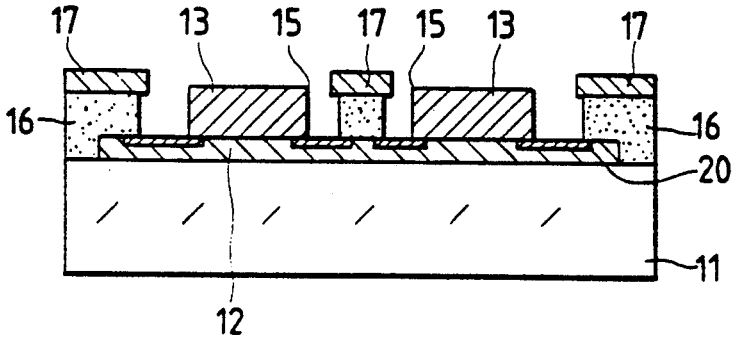
FIG. 11 is a sectional view of an electron emission element according to a third embodiment of this invention.

FIG. 11 shows a third embodiment of this invention which is similar to the embodiment of FIGS. 6, 7, and 8(*a*)–8(*e*) except for the following additional design.

In the embodiment of FIG. 11, the upper surface of a base electrode 12 which extends around emitters 13 is coated with an insulating layer 20. The insulating layer 20 suppresses a leak current to or from the surface of the base electrode 12, enabling a higher rating voltage between the base electrode 12 and a control electrode 17.

DESCRIPTION OF THE FOURTH PREFERRED EMBODIMENT

Figure 12:
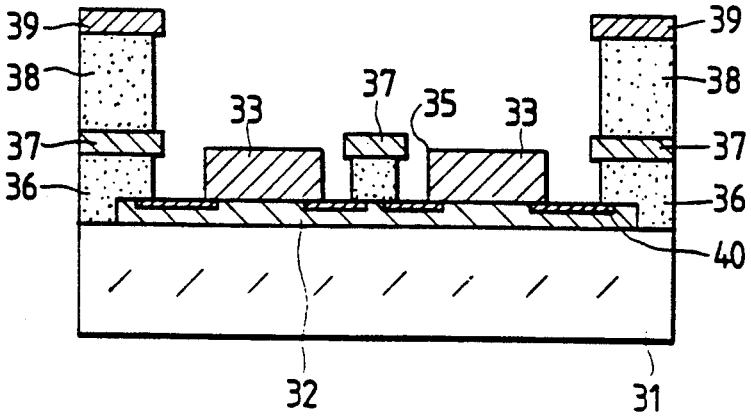
FIG. 12 is a sectional view of an electron emission element according to a fourth embodiment of this invention.

FIG. 12 shows a fourth embodiment of this invention which is similar to the embodiment of FIGS. 9 and 10 except for the following additional design.

In the embodiment of FIG. 12, the upper surface of a base electrode 32 which extends around emitters 33 is coated with an insulating layer 40. The insulating layer 40 suppresses a leak current to or from the surface of the base electrode 32, enabling a higher rating voltage between the base electrode 32 and a control electrode 37.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An electron emission element comprising:
an insulating substrate;
a base electrode formed on the insulating substrate;
a plurality of emitters formed on the base electrode and arranged radially with respect to a given point, the emitters each having a respective wedge shape disposed with a tip of the wedge shape facing toward said point;
an insulating layer formed on the substrate and the base electrode and spaced from the wedges of the emitters by given gaps; and
a control electrode formed on the insulating layer for enabling electrons to be emitted from the wedges of the emitters.

2. The electron emission element of claim 1, wherein:
the tips of the wedge-shaped emitters face a common central point.

3. The electron emission element of claim 1, further comprising:
an insulating film coating a surface of the base electrode which extends around the emitters.

4. The electron emission element of claim 1, wherein:
the insulating layer comprises a material selected from a group of materials consisting of $SiO_2$, $Al_2O_3$ and $Si_3N_4$.

5. The electron emission element of claim 4, wherein:
said base electrode comprises an electrically conductive material selected from a group consisting of Al, Ta and Cr.

6. The electron emission element of claim 1, wherein:
said base electrode comprises an electrically conductive material selected from a group consisting of Al, Ta and Cr.

7. The electron emission element of claim 1, wherein:
the emitters comprise a film made of a material selected from a group of materials consisting of Mo, W, ZrC and TiC.

8. The electron emission element of claim 7, wherein:
the insulating layer comprises a material selected from a group of materials consisting of $SiO_2$, $Al_2O_3$ and $Si_3N_4$; and
said base electrode comprises an electrically conductive material selected from a group consisting of Al, Ta and Cr.

9. An electron emission element, comprising:
an insulating substrate;
a base electrode formed on the insulating substrate;
a plurality of emitters formed on the base electrode and arranged radially with respect to a given point, the emitters each having a respective wedge shape disposed with a tip facing toward said point;
a first insulating layer formed on the substrate and the base electrode and spaced from the wedges of the emitters by given gaps;
a first control electrode formed on the first insulating layer for enabling electrons to be emitted from the wedge-shaped emitters;
a second insulating layer formed on a region of the first control electrode and extending radially outward of the emitters; and
a second control electrode formed on the second insulating layer.

10. The electron emission element of claim 9, wherein:
the tips of the wedge-shaped emitters face a common central point.

11. The electron emission element of claim 9, further comprising:
an insulating film coating a surface of the base electrode which extends around the emitters.

12. The electron emission element of claim 9, wherein:
the base electrode comprises a material selected from a group of materials consisting of Al, Au, Mo, Cr and Ta.

13. The electron emission element of claim 12, wherein:
the emitters comprise a material selected from a group of materials consisting of Mo, W., ZrC and $LaB_6$; and
the first insulating layer comprises a material selected from a group of materials consisting of $SiO_2$, $Al_2O_3$ and $Si_3N_4$.

14. The electron emission element of claim 9, wherein:
the emitters comprise a material selected from a group of materials consisting of Mo, W, ZrC and $LaB_6$.

15. The electron emission element of claim 9, wherein:
the first insulating layer comprises a material selected from a group of materials consisting of $SiO_2$, $Al_2O_3$ and $Si_3N_4$.

* * * * *